US012221660B2

(12) United States Patent
Honjo et al.

(10) Patent No.: US 12,221,660 B2
(45) Date of Patent: Feb. 11, 2025

(54) METHOD FOR PRODUCING RAIL

(71) Applicant: JFE STEEL CORPORATION, Tokyo (JP)

(72) Inventors: Minoru Honjo, Tokyo (JP); Mineyasu Takemasa, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 772 days.

(21) Appl. No.: 17/593,298

(22) PCT Filed: Mar. 6, 2020

(86) PCT No.: PCT/JP2020/009788

§ 371 (c)(1),
(2) Date: Apr. 25, 2022

(87) PCT Pub. No.: WO2020/189349

PCT Pub. Date: Sep. 24, 2020

(65) Prior Publication Data

US 2022/0267870 A1 Aug. 25, 2022

(30) Foreign Application Priority Data

Mar. 19, 2019 (JP) ..... 2019-051778

(51) Int. Cl.

| | |
|---|---|
| ***C21D 1/02*** | (2006.01) |
| ***C21D 6/00*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/12*** | (2006.01) |
| ***C22C 38/14*** | (2006.01) |
| ***C22C 38/16*** | (2006.01) |
| ***C22C 38/54*** | (2006.01) |

(52) U.S. Cl.

CPC ..... *C21D 1/02* (2013.01); *C21D 6/004* (2013.01); *C21D 6/005* (2013.01); *C21D 6/008* (2013.01); *C22C 38/002* (2013.01); *C22C 38/02* (2013.01); *C22C 38/04* (2013.01); *C22C 38/06* (2013.01); *C22C 38/12* (2013.01); *C22C 38/14* (2013.01); *C22C 38/16* (2013.01); *C22C 38/54* (2013.01)

(58) Field of Classification Search

CPC ..... C21D 1/02; C21D 6/004; C21D 6/005; C21D 6/008; C21D 9/06; C21D 8/00; C21D 9/04; C22C 38/002; C22C 38/02; C22C 38/04; C22C 38/06; C22C 38/12; C22C 38/14; C22C 38/16; C22C 38/54; C22C 38/18

USPC ..... 420/91

See application file for complete search history.

(56) References Cited

U.S. PATENT DOCUMENTS

| | | | | |
|---|---|---|---|---|
| 4,659,398 | A | 4/1987 | Heller et al. | |
| 9,765,414 | B2 | 9/2017 | Zou et al. | |
| 10,253,397 | B2 | 4/2019 | Kimura et al. | |
| 2007/0181231 | A1* | 8/2007 | Ueda | C21D 9/04 148/584 |
| 2011/0189047 | A1 | 8/2011 | Szablewski et al. | |
| 2017/0051373 | A1* | 2/2017 | Ueda | C22C 38/32 |

FOREIGN PATENT DOCUMENTS

| | | | |
|---|---|---|---|
| CN | 86100209 | A | 7/1986 |
| CN | 103898303 | A | 7/2014 |
| CN | 105051220 | A | 11/2015 |
| EP | 1711638 | A1 | 10/2006 |
| JP | 05171268 | A * | 7/1993 |
| JP | H05171268 | A | 7/1993 |
| JP | 2005171327 | A | 6/2005 |
| JP | 2005256022 | A | 9/2005 |
| JP | 2007291413 | A | 11/2007 |
| JP | 2011084785 | A | 4/2011 |
| JP | 2016053191 | A | 4/2016 |
| WO | 2005066377 | A1 | 7/2005 |
| WO | 2005085481 | A1 | 9/2005 |

OTHER PUBLICATIONS

JP-05171268-A Translation (Year: 1993).*

Feb. 17, 2022, the Extended European Search Report issued by the European Patent Office in the corresponding European Patent Application No. 20773050.8.

Sep. 15, 2022, Office Action issued by the China National Intellectual Property Administration in the corresponding Chinese Patent Application No. 202080021498.3 with English language search report.

Jun. 2, 2020, International Search Report issued in the International Patent Application No. PCT/JP2020/009788.

* cited by examiner

*Primary Examiner* — Brian D Walck
*Assistant Examiner* — Danielle M. Carda
(74) *Attorney, Agent, or Firm* — KENJA IP LAW PC

(57) ABSTRACT

Provided is a method for producing a rail, with which the sweep in the height direction of a rail before straightening can be suppressed when producing standard rails specified in JIS E 1101. The method includes subjecting a bloom having a chemical composition containing, in mass %, C: 0.60% or more and 0.85% or less, Si: 0.10% or more and 1.00% or less, and Mn: 0.10% or more and 1.30% or less, with the balance being Fe and inevitable impurities, to hot rolling to obtain a rail, subjecting the rail to accelerated cooling under conditions where a cooling start temperature T1 of rail head is 750° C. or higher and 850° C. or lower, a cooling stop temperature T2 of rail head is higher than 700° C., and T1−T2 is 20° C. or more, and then allowing the rail to be naturally cooled.

2 Claims, No Drawings

METHOD FOR PRODUCING RAIL

TECHNICAL FIELD

This disclosure relates to a method for producing a rail that is used, for example, in straight parts of passenger railways and heavy haul railways.

BACKGROUND

A railway rail is usually produced by heating a continuously-cast bloom, subjecting the bloom to hot rolling to obtain a desired rail shape, then cooling the resulting rail to room temperature, and then subjecting the rail to a straightening process and an inspection process to obtain a final product to be shipped. The following two methods are mainly known as methods for cooling the rail to room temperature after hot rolling.

A first method is to transport the rail after hot rolling directly to a cooling bed and allow the rail to be naturally cooled (natural cooling) to room temperature on the cooling bed. Rails obtained with this method are suitable for applications that do not require high hardness such as straight parts, and the rails are so-called "standard rails" as specified in JIS E 1101.

A second method is to transport the rail after hot rolling to an on-line heat treatment apparatus, where heat treatment is performed so that the rail head is accelerated cooled (slack quenched) to the pearlite transformation temperature or lower of about 400° C. to 550° C., and then transport the rail to a cooling bed and allow the rail to be naturally cooled (natural cooling) to room temperature on the cooling bed. This accelerated cooling involves slack quenching of the rail head all over the cross section, which is performed to improve the wear resistance by increasing the hardness of the rail head. Therefore, rails obtained with this method are suitable for applications under severe conditions such as sharp curves and heavy haul, and the rails are so-called "head hardened rails" as specified in JIS E 1120. For example, WO/2005/066377 (PTL 1) describes a method of producing a rail, in which hot rolling is performed, then, in a temperature range where a surface temperature of a rail head is 800° C. to 450° C., accelerated cooling is performed while keeping the rail upright during which a rail base is mechanically restrained, and then the rail is allowed to be naturally cooled to room temperature.

CITATION LIST

Patent Literature

PTL 1: WO/2005/066377

SUMMARY

Technical Problem

However, when a rail is cooled to room temperature on a cooling bed, sweep (upsweep) occurs in the height direction because there is no restriction in the height direction. If the sweep becomes severe, it is difficult to transport the rail to the subsequent straightening process (transport the rail out from the cooling bed to the subsequent process) or to straighten the rail. Therefore, suppressing the sweep of a rail to be transported to a straightening process can facilitate the straightening of the rail. As disclosed herein, "sweep in the height direction" refers to sweep in the vertical direction when the rail is upright.

In the case of a head hardened rail, the entire rail, including the head and the base, undergoes pearlite transformation during the accelerated cooling process, so that the sweep in the height direction of the rail before straightening is small. However, in the case of an standard rail, the rail after hot rolling is transported directly to a cooling bed and is allowed to be naturally cooled to room temperature on the cooling bed. As a result, a large difference in cooling rate occurs between the head and the base of the rail, and the head and the base of the rail undergo pearlite transformation at different points of time, which in turn tends to cause severe sweep. In other words, in the case of producing an standard rail by general producing processes, the sweep amount in the height direction tends to be large. The sweep amount in the height direction is particularly noticeable when the rail is transported to a cooling bed with a length of 100 m or more without being cut by a hot saw after hot rolling.

In view of these situations, it could be helpful to provide a method of producing a rail with which the sweep in the height direction of a rail before straightening can be suppressed in the production of standard rails specified in JIS E 1101.

Solution to Problem

As a result of intensive studies made to solve the above problems, we discovered the following. That is, in the case of producing standard rails, a rail after hot rolling is usually transported directly to a cooling bed and allowed to be naturally cooled to room temperature without accelerated cooling. However, we discovered that by very lightly accelerated cooling the rail after hot rolling, specifically, by stopping the accelerated cooling at a temperature (higher than 700° C.) at which the rail head does not undergo pearlite transformation, it is possible to produce an standard rail in which the sweep in the height direction on a cooling bed is suppressed. If the rail head is accelerated cooled to the pearlite transformation temperature or lower, only the surface layer of the rail head undergoes pearlite transformation during the accelerated cooling process, and the untransformed part inside the rail head undergoes pearlite transformation on a cooling bed, which in turn causes severe sweep. Therefore, it is important to set the cooling stop temperature of the rail head to higher than 700° C.

Based on these discoveries, we provide the following.

[1]. A method for producing a rail, the method comprising subjecting a bloom to hot rolling to obtain a rail, wherein the bloom comprises a chemical composition containing (consisting of), in mass %, C: 0.60% or more and 0.85% or less, Si: 0.10% or more and 1.00% or less, and Mn: 0.10% or more and 1.30% or less, with the balance being Fe and inevitable impurities, subjecting the rail to accelerated cooling under a set of conditions wherein a cooling start temperature of rail head, expressed as T1, is 750° C. or higher and 850° C. or lower, a cooling stop temperature of rail head, expressed as T2, is higher than 700° C., and T1−T2 is 20° C. or more, and then allowing the rail to be naturally cooled.

[2]. The method of producing a rail according to [1], wherein the chemical composition further contains, in mass %, at least one selected from the group consisting of Cr: 1.50% or less,
V: 0.50% or less,
Cu: 0.50%% or less,
Ni: 0.50% or less,
Nb: 0.10%% or less,
Mo: 0.50% or less,
Al: 0.05% or less,
W: 0.50% or less,
B: 0.005% or less,
Ti: 0.05% or less,
Mg: 0.020% or less, and
Ca: 0.020% or less.

Advantageous Effect

According to the method of producing a rail of the present disclosure, the sweep in the height direction of a rail before straightening can be suppressed in the production of standard rails specified in JIS E 1101.

DETAILED DESCRIPTION

A method of producing a rail according to an embodiment of the present disclosure includes subjecting a bloom having a predetermined chemical composition to hot rolling to obtain a rail, subjecting the rail to accelerated cooling under predetermined conditions, and then allowing the rail to be naturally cooled. The rail is then subjected to a straightening process and an inspection process with the usual methods to obtain a final product.

(Chemical Composition)

First, the chemical composition of the bloom and the rail will be described. Note that the unit "%" relating to the content of elements in the chemical composition refers to "mass %" unless specified otherwise.

C: 0.60% or More and 0.85% or Less

C is an essential element for forming cementite in a pearlitic structure to ensure the strength of the rail. When the C content is less than 0.60%, it is difficult to ensure the strength of the rail. In addition, proeutectoid ferrite tends to be formed, and pearlite transformation starts with the proeutectoid ferrite being a nucleation site. As a result, sweep becomes severe while transporting the rail to a cooling bed. On the other hand, when the C content is more than 0.85%, proeutectoid cementite is formed during the accelerated cooling in the present disclosure, and pearlite transformation starts with the proeutectoid cementite being a nucleation site. As a result, sweep becomes severe while transporting the rail to a cooling bed. Therefore, the C content is set to 0.60% or more and 0.85% or less.

Si: 0.10% or More and 1.00% or Less

Si is added as a deoxidizing agent, and it is added to increase the strength by lowering the pearlite transformation temperature and reducing the lamellar spacing. When the Si content is less than 0.10%, the effect of deoxidation is small, and the effect of increasing the strength cannot be sufficiently obtained. In addition, proeutectoid ferrite tends to be formed, and pearlite transformation starts with the proeutectoid ferrite being a nucleation site. As a result, sweep becomes severe while transporting the rail to a cooling bed. On the other hand, when the Si content is more than 1.00%, oxides are formed in the rail steel due to the high binding power of Si with oxygen, and pearlite transformation starts with the oxygen being a nucleation site. As a result, sweep becomes severe while transporting the rail to a cooling bed. Therefore, the Si content is set to 0.10% or more and 1.00% or less.

Mn: 0.10% or More and 1.30% or Less

Mn is added to increase the strength by lowering the pearlite transformation temperature and reducing the lamellar spacing. When the Mn content is less than 0.10%, the effect of increasing the strength cannot be sufficiently obtained. In addition, proeutectoid ferrite tends to be formed, and pearlite transformation starts with the proeutectoid ferrite being a nucleation site. As a result, sweep becomes severe while transporting the rail to a cooling bed. On the other hand, when the Mn content is more than 1.30%, coarse MnS is formed, and pearlite transformation starts with the MnS being a nucleation site. As a result, sweep becomes severe while transporting the rail to a cooling bed. Therefore, the Mn content is set to 0.10% or more and 1.30% or less.

The chemical composition of the bloom and the rail may contain the above basic components, with the balance being Fe and inevitable impurities. However, the chemical composition may further contain at least one selected from the following elements as an optional element to the extent that the effect of the present disclosure will not be substantially affected.

Cr: 1.50% or Less

Cr is an element that increase the strength of the rail. To obtain this effect, the Cr content is preferably 0.10% or more. However, when the Cr content is more than 1.50%, coarse cementite is formed, which facilitates the occurrence of rolling contact fatigue in the rail. Therefore, when Cr is added, the Cr content is set to 1.50% or less.

V: 0.50% or Less

V is an element that forms carbonitrides and increases the strength of the rail by precipitation strengthening. To obtain this effect, the V content is preferably 0.005% or more. However, when the C content is more than 0.50%, the alloy cost increases. Therefore, when V is added, the V content is set to 0.50% or less.

Cu: 0.50% or Less

Cu is an element that further increases the strength of the rail by solid solution strengthening. To obtain this effect, the Cu content is preferably 0.005% or more. However, when the Cu content is more than 0.50%, Cu cracking is likely to occur. Therefore, when Cu is added, the Cu content is set to 0.50% or less.

Ni: 0.50% or Less

Ni is an element that increases the strength of the rail without deteriorating the ductility. In addition, Cu cracking is suppressed by adding Ni in combination with Cu. Therefore, when Cu is added, it is desirable to add Ni as well. To obtain these effects, the Ni content is preferably 0.005% or more. However, when the Ni content is more than 0.50%, the alloy cost increases. Therefore, when Ni is added, the Ni content is set to 0.50% or less.

Nb: 0.10% or Less

Nb is an element that combines with C and N in the steel and precipitates as carbides, nitrides or carbonitrides during and after rolling to increase the hardness of the rail. To obtain this effect, the Nb content is preferably 0.005% or more. However, when the Nb content is more than 0.10%, the alloy cost increases. Therefore, when Nb is added, the Nb content is set to 0.10% or less.

Mo: 0.50% or Less

Mo is an element that further increases the strength of the rail by solid solution strengthening. To obtain this effect, the Mo content is preferably 0.005% or more. However, when the Mo content is more than 0.50%, the alloy cost increases. Therefore, when Mo is added, the Mo content is set to 0.50% or less.

Al: 0.05% or Less

Al is an element added as a deoxidation agent. To obtain this effect, the Al content is preferably 0.001% or more. However, when the Al content is more than 0.05%, the alloy cost increases. Therefore, when Al is added, the Al content is set to 0.05% or less.

W: 0.50% or Less

W is an element that precipitates as carbides to further increase the strength of the rail by precipitation strengthening. To obtain this effect, the W content is preferably 0.001% or more. However, when the W content is more than 0.50%, the alloy cost increases. Therefore, when W is added, the W content is set to 0.50% or less.

B: 0.005% or Less

B is an element that precipitates as nitrides to further increase the strength of the rail by precipitation strengthening. To obtain this effect, the B content is preferably 0.0001% or more. However, when the B content is more than 0.005%, the alloy cost increases. Therefore, when B is added, the B content is set to 0.005% or less.

Ti: 0.05% or Less

Ti is an element that precipitates as carbides, nitrides or carbonitrides to further increase the strength of the rail by precipitation strengthening. To obtain this effect, the Ti content is preferably 0.001% or more. However, when the Ti content is more than 0.05%, the alloy cost increases. Therefore, when Ti is added, the Ti content is set to 0.05% or less.

Mg: 0.020% or Less

Mg is an element that combines with oxygen to precipitate MgO to further increase the strength. To obtain this effect, the Mg content is preferably 0.001% or more. However, when the Mg content is more than 0.020%, rolling contact fatigue is likely to occur due to the increase in MgO. Therefore, when Mg is added, the Mg content is set to 0.020% or less.

Ca: 0.020% or Less

Ca is an element that combines with oxygen to precipitate CaO to further increase the strength. To obtain this effect, the Ca content is preferably 0.001% or more. However, when the Ca content is more than 0.020%, rolling contact fatigue is likely to occur due to the increase in CaO. Therefore, when Ca is added, the Ca content is set to 0.020% or less.

(Hot Rolling)

In the present embodiment, a cast steel whose chemical composition has been adjusted as above is subjected to hot rolling to obtain a rail. This process can be performed, for example, with the usual method described below. First, a steel is obtained by steelmaking in a converter or an electric furnace, and the steel is subjected to secondary refining such as degassing as necessary. Subsequently, the chemical composition of the steel is adjusted to the above ranges. Next, the obtained steel is subjected to continuous casting to obtain a cast steel (bloom). Next, the bloom is heated to 1200° C. or higher and 1350° C. or lower in a heating furnace, and then the bloom is subjected to hot rolling to obtain a rail. The hot rolling preferably has a rolling finish temperature of 850° C. or higher and 1000° C. or lower.

(Accelerated Cooling)

In the present embodiment, it is important that the rail after hot rolling be then subjected to accelerated cooling under the following conditions (A) to (C). The accelerated cooling is slack quenching using an on-line heat treatment apparatus. The coolant is not particularly limited and may be at least one selected from air, spray water, mist or the like, among which air is preferred.

(A) Cooling Start Temperature T1 of Rail Head (Surface): 750° C. or Higher and 850° C. or Lower When the cooling start temperature T1 is lower than 750° C., the temperature is different between the head and the base of the rail. As a result, sweep becomes severe on a cooling bed. Therefore, it is important that the cooling start temperature T1 be 750° C. or higher, and it is preferably T1 be 755° C. or higher. When the accelerated cooling is started at temperatures higher than 850° C., the head of the rail cools faster than the base, and the head and the base of the rail undergo pearlite transformation at different points of time. As a result, sweep becomes severe on a cooling bed. Therefore, it is important that the cooling start temperature T1 be 850° C. or lower, and it is preferable that T1 be 845° C. or lower. The cooling start temperature T1 can be adjusted according to the rolling finish temperature of the hot rolling and the time until the rail is transported to the on-line heat treatment apparatus after hot rolling.

(B) Cooling Stop Temperature T2 of Rail Head (Surface): Higher than 700° C.

It is most important in the present embodiment that the cooling stop temperature T2 be higher than 700° C. When the accelerated cooling is stopped at temperatures of 700° C. or lower, only the surface layer of the rail head undergoes pearlite transformation during the accelerated cooling process, and the untransformed part inside the rail head undergoes pearlite transformation on a cooling bed. As a result, sweep becomes severe on the cooling bed. Therefore, it is important that the cooling stop temperature T2 be higher than 700° C., and it is preferably that T2 be 705° C. or higher. The cooling stop temperature T2 can be adjusted, for example, by the conditions of supplying coolant, such as the air flow rate, and the time spent by the rail in the on-line heat treatment apparatus.

(C) T1−T2 (i.e., T1 Minus T2): 20° C. or More

It is important to set the upper limit of the cooling stop temperature T2 so that T1−T2 is 20° C. is or more. When T1−T2 is less than 20° C., the temperature range in which the accelerated cooling of the present embodiment is performed is too small. As in the case of producing standard rails with the usual method, a large difference in cooling rate occurs between the head and the base of the rail, the head and the base of the rail undergo pearlite transformation at different points of time, and sweep becomes severe on a cooling bed. The upper limit of T1−T2 is not particularly limited as long as T1 and T2 satisfy the condition (A) and the condition (B) above, respectively.

The average cooling rate of the surface temperature of the rail head during the accelerated cooling is not particularly limited, and it may be the cooling rate in a common accelerated cooling process used in the production of head hardened rails. For example, it may be 1.0° C./s or higher and 10° C./s or lower.

(Allowing Rail to be Naturally Cooled)

In the present embodiment, the rail is allowed to be naturally cooled to room temperature after the accelerated cooling. In the cooling process, the rail is transported from the on-line heat treatment apparatus to a cooling bed, and the rail is naturally cooled to room temperature on the cooling bed. The average cooling rate of the surface temperature of the rail head in the process of allowing the rail to be naturally cooled is not particularly limited. Generally, it may be in a range of 0.2° C./s or higher and 0.6° C./s or lower.

According to the method of producing a rail of the present embodiment described above, sweep in the height direction of a rail before straightening can be suppressed when producing standard rails specified in JIS E 1101. The length of the rail to be supplied to a cooling bed, that is, before straightening, is not particularly limited. However, when the length is 50 m or more, the effect of the present disclosure is remarkable, which is advantageous.

EXAMPLES

Example 1

Blooms having the chemical composition listed in Table 1 (with the balance being Fe and inevitable impurities) were heated to 1250° C. and then subjected to hot rolling to obtain rails of 100 m in length. The rolling finish temperature was 900° C. The resulting rails were then transported to an on-line heat treatment apparatus and subjected to accelerated cooling under the conditions listed in Table 2. The rails were then transported to a cooling bed and allowed to be naturally cooled to room temperature. The average cooling rate during the process of allowing the rail to be naturally cooled was 0.4° C./s. Then, the heights of both ends of the rail from the cooling bed were measured by a scale, and the average value is listed in Table 2 as the "sweep amount in height direction on cooling bed".

TABLE 1

| Steel sample | Chemical composition (mass %) | | | |
|---|---|---|---|---|
| ID | C | Si | Mn | Remarks |
| A-1 | 0.68 | 0.21 | 0.83 | Disclosed steel |

TABLE 2

| | Accelerated cooling conditions | | | | | |
|---|---|---|---|---|---|---|
| No. | Cooling start temperature T1 (° C.) | Cooling stop temperature T2 (° C.) | Average cooling rate between T1 and T2 (° C./s) | T1-T2 (° C.) | Sweep amount in height direction on cooling bed (m) | Remarks |
| 1 | No accelerated cooling | | | | 2.0 | Comparative Example |
| 2 | 745 | 705 | 6.0 | 40 | 1.6 | Comparative Example |
| 3 | 750 | 695 | 5.2 | 55 | 1.7 | Comparative Example |
| 4 | 750 | 705 | 4.8 | 45 | 1.2 | Example |
| 5 | 790 | 705 | 3.9 | 85 | 1.0 | Example |
| 6 | 790 | 750 | 4.0 | 40 | 0.6 | Example |
| 7 | 760 | 725 | 4.5 | 35 | 0.8 | Example |
| 8 | 760 | 710 | 2.9 | 50 | 0.9 | Example |
| 9 | 780 | 735 | 5.0 | 45 | 0.7 | Example |
| 10 | 750 | 732 | 4.7 | 18 | 1.6 | Comparative Example |
| 11 | 855 | 705 | 5.5 | 150 | 1.8 | Comparative Example |
| 12 | 845 | 750 | 5.0 | 95 | 1.4 | Example |

As can be seen from the results listed in Table 2, the rails of Examples all had a sweep amount in the height direction on the cooling bed of 1.5 m or less.

Example 2

Blooms having the chemical composition listed in Table 3 (with the balance being Fe and inevitable impurities) were heated to 1260° C. and then subjected to hot rolling to obtain rails of 75 m in length. The rolling finish temperature was 855° C. The resulting rails were then transported to an on-line heat treatment apparatus and subjected to accelerated cooling under the conditions listed in Table 4. The average cooling rate during the accelerated cooling was 5.0° C./s. The rails were then transported to a cooling bed and allowed to be naturally cooled to room temperature. The average cooling rate during the process of allowing the rail to be naturally cooled was 0.4° C./s. Then, the "sweep amount in height direction on cooling bed" obtained with the same method as in Example 1 is listed in Table 4.

TABLE 3

| Steel sample | Chemical composition (mass %) | | | | | | | | | | | | | | | |
|---|---|---|---|---|---|---|---|---|---|---|---|---|---|---|---|---|
| ID | C | Si | Mn | Cr | V | Cu | Ni | Nb | Mo | Al | W | B | Ti | Mg | Ca | Remarks |
| B-1 | 0.68 | 1.00 | 0.48 | 0.26 | — | — | — | — | — | — | — | — | — | — | — | Disclosed steel |
| B-2 | 0.69 | 0.25 | 0.85 | 0.61 | — | — | — | — | — | — | — | — | — | — | — | Disclosed steel |
| B-3 | 0.70 | 0.42 | 0.40 | — | — | — | — | — | — | — | — | — | — | — | — | Disclosed steel |
| B-4 | 0.74 | 0.88 | 0.46 | 0.79 | — | — | — | — | — | — | — | — | — | — | — | Disclosed steel |

TABLE 3-continued

| Steel sample ID | Chemical composition (mass %) C | Si | Mn | Cr | V | Cu | Ni | Nb | Mo | Al | W | B | Ti | Mg | Ca | Remarks |
|---|---|---|---|---|---|---|---|---|---|---|---|---|---|---|---|---|
| B-5 | 0.60 | 0.87 | 0.47 | — | — | — | — | — | — | — | — | — | — | — | — | Disclosed steel |
| B-6 | 0.61 | 0.42 | 0.54 | 0.21 | — | — | — | — | — | — | — | — | — | — | — | Disclosed steel |
| B-7 | 0.74 | 0.69 | 0.56 | 0.79 | — | — | — | — | — | — | — | — | — | — | — | Disclosed steel |
| B-8 | 0.74 | 0.10 | 1.29 | — | — | — | — | — | — | — | — | — | — | — | — | Disclosed steel |
| B-9 | 0.74 | 1.00 | 0.83 | 0.05 | — | — | — | — | — | — | — | — | — | — | — | Disclosed steel |
| B-10 | 0.74 | 0.48 | 0.71 | 0.32 | — | — | — | — | — | — | — | — | — | — | — | Disclosed steel |
| B-11 | 0.59 | 0.65 | 0.81 | — | — | — | — | — | — | — | — | — | — | — | — | Comparative steel |
| B-12 | 0.87 | 0.24 | 0.81 | — | — | — | — | — | — | — | — | — | — | — | — | Comparative steel |
| B-13 | 0.72 | 0.05 | 0.81 | — | — | — | — | — | — | — | — | — | — | — | — | Comparative steel |
| B-14 | 0.71 | 1.05 | 0.82 | — | — | — | — | — | — | — | — | — | — | — | — | Comparative steel |
| B-15 | 0.72 | 0.25 | 0.05 | — | — | — | — | — | — | — | — | — | — | — | — | Comparative steel |
| B-16 | 0.73 | 0.29 | 1.32 | — | — | — | — | — | — | — | — | — | — | — | — | Comparative steel |
| B-17 | 0.73 | 0.63 | 0.81 | — | — | — | — | — | — | — | — | — | — | — | — | Disclosed steel |
| B-18 | 0.73 | 0.59 | 0.81 | — | — | — | — | — | — | — | — | — | — | — | — | Disclosed steel |
| B-19 | 0.73 | 0.55 | 0.10 | 1.00 | — | — | — | 0.05 | — | — | — | — | — | — | — | Disclosed steel |
| B-20 | 0.73 | 0.51 | 0.61 | 0.74 | — | — | — | 0.10 | — | — | — | — | — | — | — | Disclosed steel |
| B-21 | 0.68 | 0.25 | 1.10 | 0.25 | — | — | — | — | 0.04 | — | — | — | — | — | — | Disclosed steel |
| B-22 | 0.68 | 0.35 | 1.05 | 0.29 | — | — | 0.30 | — | — | — | — | — | — | — | — | Disclosed steel |
| B-23 | 0.68 | 0.55 | 0.55 | — | 0.30 | 0.50 | — | — | — | — | — | — | — | — | — | Disclosed steel |
| B-24 | 0.68 | 0.25 | 1.20 | 0.29 | — | — | — | — | — | 0.05 | 0.50 | — | — | — | — | Disclosed steel |
| B-25 | 0.68 | 0.88 | 0.55 | — | — | — | — | — | — | — | — | 0.003 | 0.05 | — | — | Disclosed steel |
| B-26 | 0.68 | 0.95 | 0.56 | 0.79 | — | — | — | 0.05 | — | — | — | — | — | — | — | Disclosed steel |
| B-27 | 0.70 | 0.25 | 0.88 | 0.05 | — | — | — | — | — | — | — | — | — | 0.018 | — | Disclosed steel |
| B-28 | 0.69 | 0.30 | 0.81 | 0.10 | — | — | — | — | — | — | — | — | — | — | 0.017 | Disclosed steel |

TABLE 4

| No. | Steel sample ID | Accelerated cooling conditions: Cooling start temperature T1 (° C.) | Cooling stop temperature T2 (° C.) | T1-T2 (° C.) | Sweep amount in height direction on cooling bed (m) | Remarks |
|---|---|---|---|---|---|---|
| 1 | B-1 | 750 | 705 | 45 | 1.3 | Example |
| 2 | B-2 | 770 | 706 | 64 | 1.2 | Example |
| 3 | B-3 | 770 | 705 | 65 | 1.3 | Example |
| 4 | B-4 | 770 | 705 | 65 | 1.3 | Example |
| 5 | B-5 | 770 | 705 | 65 | 1.3 | Example |
| 6 | B-6 | 770 | 705 | 65 | 1.3 | Example |
| 7 | B-7 | 760 | 708 | 52 | 1.4 | Example |
| 8 | B-8 | 760 | 707 | 53 | 1.2 | Example |
| 9 | B-9 | 760 | 710 | 50 | 1.2 | Example |
| 10 | B-10 | 760 | 705 | 55 | 1.3 | Example |
| 11 | B-11 | 760 | 706 | 54 | 1.6 | Comparative Example |
| 12 | B-12 | 760 | 705 | 55 | 1.6 | Comparative Example |
| 13 | B-13 | 760 | 707 | 53 | 1.6 | Comparative Example |
| 14 | B-14 | 790 | 707 | 83 | 1.6 | Comparative Example |
| 15 | B-15 | 800 | 706 | 94 | 1.6 | Comparative Example |
| 16 | B-16 | 770 | 705 | 65 | 1.6 | Comparative Example |
| 17 | B-17 | 775 | 725 | 50 | 1.0 | Example |
| 18 | B-18 | 760 | 740 | 20 | 0.8 | Example |
| 19 | B-19 | 775 | 745 | 30 | 0.8 | Example |
| 20 | B-20 | 765 | 720 | 45 | 1.0 | Example |
| 21 | B-21 | 780 | 701 | 79 | 1.4 | Example |
| 22 | B-22 | 755 | 720 | 35 | 1.0 | Example |
| 23 | B-23 | 760 | 720 | 40 | 1.1 | Example |
| 24 | B-24 | 785 | 720 | 65 | 0.9 | Example |
| 25 | B-25 | 755 | 720 | 35 | 0.9 | Example |
| 26 | B-26 | 750 | 715 | 35 | 1.0 | Example |
| 27 | B-27 | 755 | 705 | 50 | 1.2 | Example |
| 28 | B-28 | 760 | 705 | 55 | 1.2 | Example |

As can be seen from the results listed in Table 4, the rails of Examples all had a sweep amount in the height direction on the cooling bed of 1.5 m or less.

INDUSTRIAL APPLICABILITY

According to the method of producing a rail of the present disclosure, sweep in the height direction of a rail before straightening can be suppressed in the production of standard rails specified in JIS E 1101.

The invention claimed is:

1. A method for producing a rail, the method comprising subjecting a bloom to hot rolling to obtain a rail, wherein the bloom comprises a chemical composition containing, in mass %, C: 0.60% or more and 0.85% or less,
Si: 0.10% or more and 1.00% or less, and
Mn: 0.10% or more and 1.30% or less,
with the balance being Fe and inevitable impurities, subjecting the rail to accelerated cooling under a set of conditions wherein a cooling start temperature of rail head, expressed as T1, is 750° C. or higher and 850° C. or lower, a cooling stop temperature of rail head, expressed as T2, is higher than 700° C., and T1-T2 is 20° C. or more, and then allowing the rail to be naturally cooled, wherein an average cooling rate of the surface temperature of the rail head during the accelerated cooling is 1.0° C./s or higher and 10° C./s or lower, and an average cooling rate of the surface temperature of the rail head during the natural cooling is 0.2° C./s or higher and 0.6° C./s or lower.

2. The method of producing a rail according to claim 1, wherein the chemical composition further contains, in mass %, at least one selected from the group consisting of Cr: 1.50% or less,
V: 0.50% or less,
Cu: 0.50% or less,
Ni: 0.50% or less,
Nb: 0.10% or less,
Mo: 0.50% or less,
Al: 0.05% or less,
W: 0.50% or less,
B: 0.005% or less,
Ti: 0.05% or less,
Mg: 0.020% or less, and
Ca: 0.020% or less.

* * * * *